US007185586B2

(12) United States Patent
Mukaijima et al.

(10) Patent No.: US 7,185,586 B2
(45) Date of Patent: Mar. 6, 2007

(54) TYPE-PRINTER

(75) Inventors: Katsutoshi Mukaijima, Higashikurume (JP); Hiroyuki Tsugaru, Tokorozawa (JP); Masao Kunita, Sayama (JP)

(73) Assignee: Citizen Watch Co., Ltd., Tokyo (JP)

( * ) Notice: Subject to any disclaimer, the term of this patent is extended or adjusted under 35 U.S.C. 154(b) by 17 days.

(21) Appl. No.: 10/866,783

(22) Filed: Jun. 15, 2004

(65) Prior Publication Data

US 2004/0258446 A1 Dec. 23, 2004

(30) Foreign Application Priority Data

Jun. 23, 2003 (JP) ..... 2003-177639
Jan. 21, 2004 (JP) ..... 2004-013635

(51) Int. Cl.
*B41J 7/48* (2006.01)
*B41J 1/48* (2006.01)

(52) U.S. Cl. ..... 101/93.21; 101/99; 101/95; 101/110

(58) Field of Classification Search ..... 101/93.29
See application file for complete search history.

(56) References Cited

U.S. PATENT DOCUMENTS 4,244,290 A * 1/1981 Tamai et al. ..... 101/99
4,284,002 A * 8/1981 Shimodaira et al. ..... 101/99
5,069,123 A * 12/1991 Murata et al. ..... 101/93.21

FOREIGN PATENT DOCUMENTS

JP 53-15927 2/1978
JP 53-49527 5/1978
JP 05131691 A * 5/1993

* cited by examiner

*Primary Examiner*—Daniel J. Colilla
(74) *Attorney, Agent, or Firm*—Smith, Gambrell & Russell, LLP

(57) ABSTRACT

A select lever and a permanent magnet of a type selection mechanism of a type-printer are arranged with a gap between the magnet and the distal end of the lower part of the lever. The select lever is located untouched in a stable position that is settled by the respective magnetic polarities of the permanent magnet and the distal end of the lower part of the lever imparted by a magnetization coil.

20 Claims, 12 Drawing Sheets

PRIOR ART

TYPE-PRINTER

BACKGROUND OF THE INVENTION

1. Field of the Invention

The present invention relates to a compact type-printer using a type ring train.

2. Description of the Related Art

Known printers that are provided with a type ring train and type selection mechanisms are described in Japanese Patent Applications Laid-Open Nos. 53-15927 and 53-49527, for example. In these printers, desired types for printing are selected by engaging and stopping rotating type rings by means of select levers.

FIG. 12 shows an outline of a type selection mechanism of the printer of this type. A select lever 60 is formed of a magnetic material, and its central part is rotatably supported by a shaft 63. The upper end part of the lever 60 is provided with an engaging portion 62 that engages a type ring 61. The select lever 60 rotates around the shaft 63 as its lower end part is driven by electromagnetic means. The electromagnetic means is composed of a magnetization coil 64 and a permanent magnet 65. The coil 64 is located so as to enclose the lower part of the select lever 60, while the magnet 65 is opposed to the lower end of the lever 60. The permanent magnet 65 has yokes 66 and 67 on its N and S poles, respectively. The lower end part of the lever 60 moves between the N- and S-side yokes 66 and 67. If the magnetization coil 64 imparts N or S polarity to the lower end of the select lever 60, attractive and repulsive forces act between the yokes 66 and 67, whereupon the select lever 60 rocks.

In FIG. 12, numeral 69 denotes a drive shaft; 70, reset cam; 71, type; 72, platen; 73, printing paper; 74, ink ribbon; and 75, character selection teeth engaging with the engaging portion 62.

The type selection mechanism constructed in this manner operates with reliability and consumes little power. The lower end part of the select lever 60 is located between the N- and S-side yokes 66 and 67. When the lever 60 is driven by the electromagnetic means, it runs against the respective side faces of the yokes 66 and 67 and is positioned. In this case, direct contact between the magnetic members considerably varies attractive force that is based on magnetic force, depending on the extent of treatment on the contact surfaces of the members. If a nonmagnetic film 68 is set between the select lever 60 and the yokes 66 and 67 in order to ease the shock of a collision, the magnetic force is weakened, so that the action of the select lever 60 is destabilized. If a trace of dust (about 0.1-mm particles) is trapped between the lever 60 and the yokes 66 and 67, moreover, the contact between these members is rendered unstable, and abrasion of contact regions must be taken into consideration.

SUMMARY OF THE INVENTION

The object of the present invention is to provide a high-durability type-printer, in which desired types for printing can be selected by securely engaging and stopping type rings by means of select levers that constitute type selection mechanisms.

A type-printer according to the present invention comprises a type ring having types on the peripheral surface thereof, a permanent magnet, a select lever formed of a magnetic material, supported for rocking motion around a shaft, and having an engaging portion on one end thereof to engage the type ring and an opposite portion on the other end to face the permanent magnet across a gap, and a coil for imparting magnetic polarity to the select lever. The select lever is rocked by means of attractive or repulsive force produced between the magnetic polarity of the select lever imparted by the coil and the magnetic polarity of the permanent magnet, whereby the engaging portion of the select lever is anchored to or disengaged from the type ring to select the types. The select lever is located in a stable position settled by the respective magnetic polarities of the select lever and the permanent magnet with a gap left between the opposite portion and the permanent magnet. The opposite portion extends long from the other end of the select lever in the direction across N and S poles of the opposite permanent magnet.

According to the present invention, the stability of the select lever in a standby position for character selection can be ensured, and the select lever can be smoothly moved from the standby position to a character select position. Further, the gap between the permanent magnet and the end part of the select lever can be adjusted to secure the action of the select lever, and the adjusted gap cannot be easily influenced by temperature change.

Since the select lever is positioned untouched, its action can be secured without involving unevenness in attractive or repulsive force. Since the select lever is spaced from the permanent magnet when it acts, moreover, dust or the like cannot be easily trapped between the lever and the magnet, so that the lever seldom suffers malfunction. The select lever is highly stable in the standby position and the character select position, so that the printing operation is reliable.

BRIEF DESCRIPTION OF THE DRAWINGS

The above and other objects and features of the invention will be more apparent from the ensuing description of the embodiments taken in connection with the accompanying drawings, in which.

DESCRIPTION OF THE PREFERRED EMBODIMENTS

A type-printer according to a first embodiment of the present invention will now be described with reference to FIGS. 1 to 4.

Figure 1:
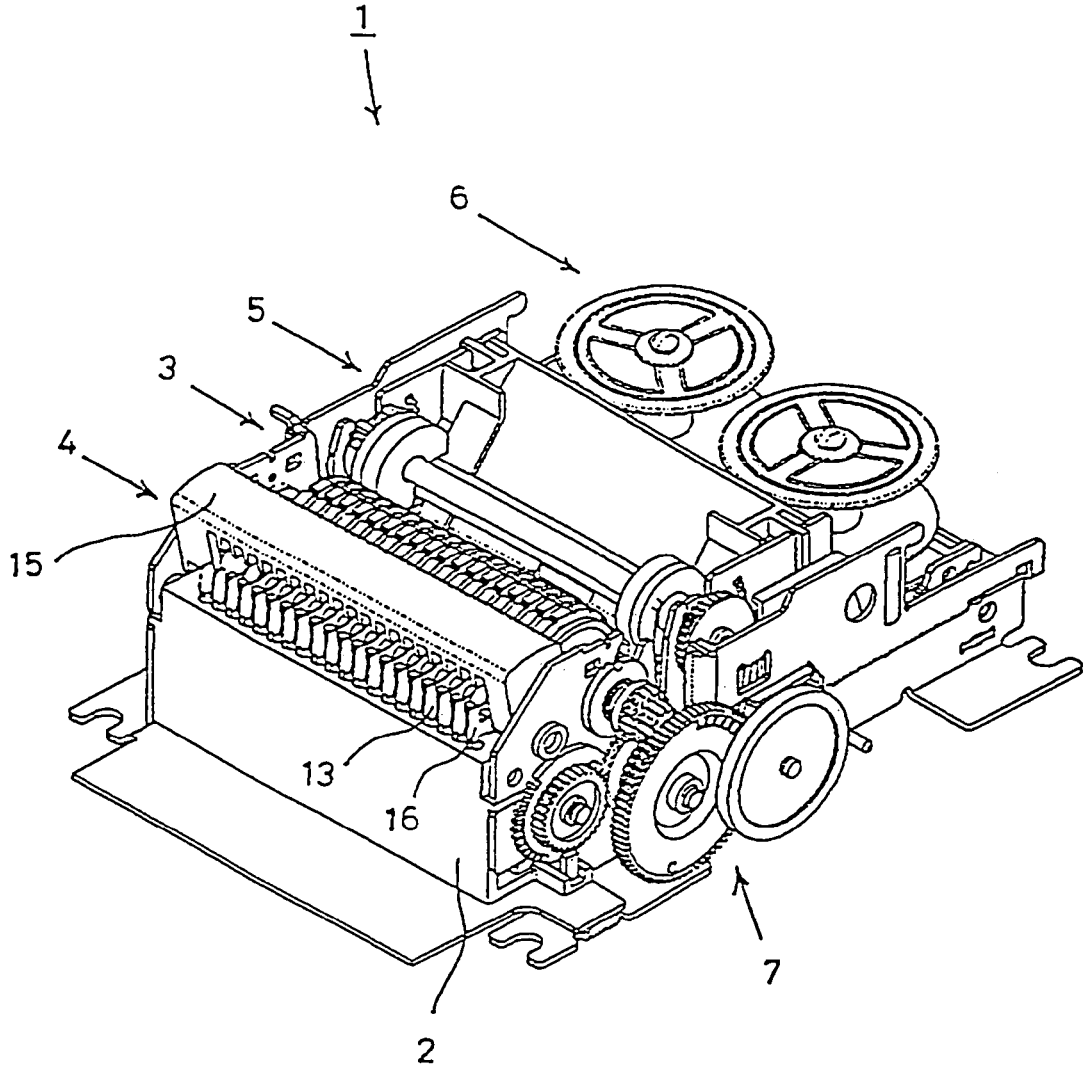
FIG. 1 is a perspective view showing an outline of a type-printer according to the invention.

As shown in FIG. 1, a machine frame 2 of a type-printer 1 is provided with a type ring train 3, type selection mechanisms 4, a printing mechanism 5, and a ribbon feed mechanism 6. These elements are driven with their respective timings by means of a built-in motor with the aid of a gear train 7.

Figure 2:
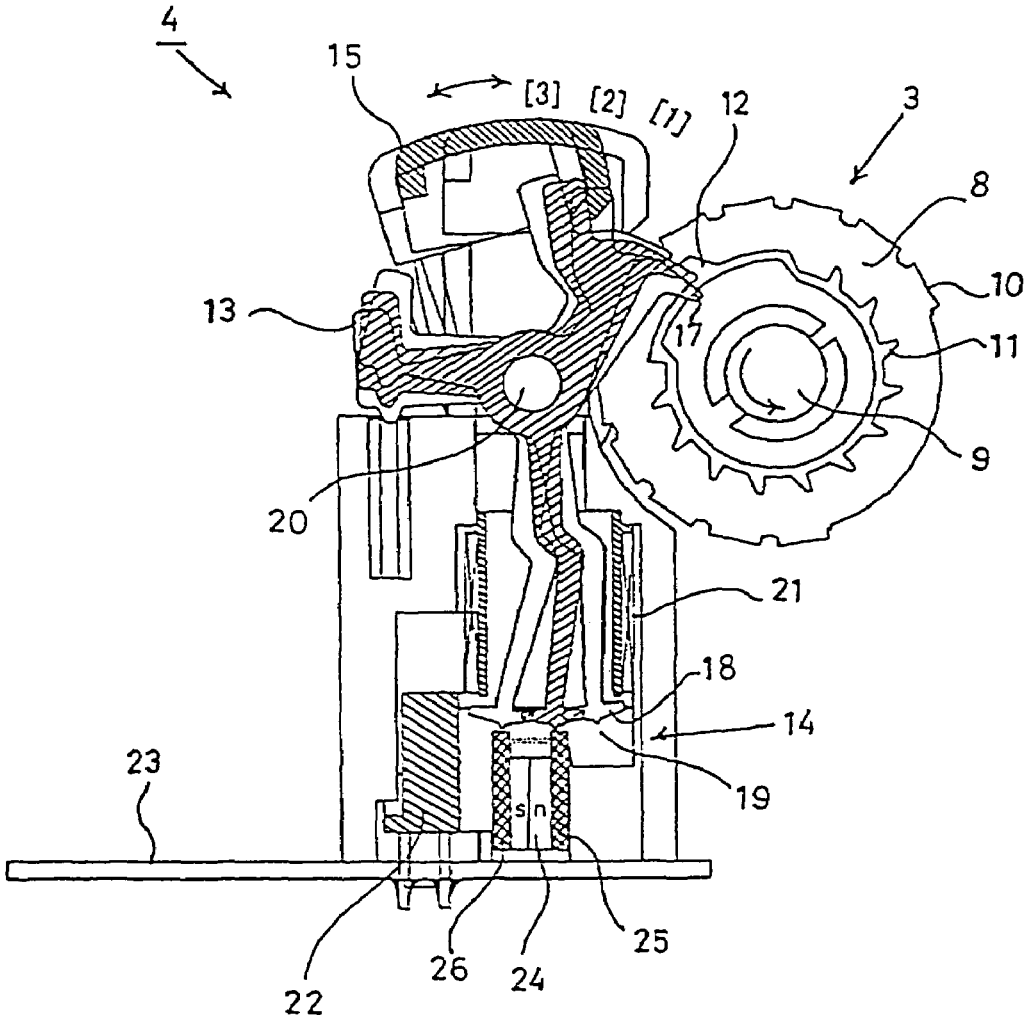
FIG. 2 is a side view showing outlines of a type ring, select lever, and electromagnetic means used in the type-printer of the first embodiment of the invention.

The ring train 3 is formed of type rings 8 as many as necessary columns (18 columns in the example of FIG. 1) for printing, which are mounted on one operating shaft 9. As shown in FIG. 2, each type ring 8 is caused frictionally to engage the shaft 9 by a C-ring. If a resistance of a given or higher level is applied to the type ring 8, therefore, the ring 8 slips on the shaft 9. Even if the shaft 9 continues to rotate, therefore, the ring 8 ceases to rotate. A plurality of types 10 are arranged on the peripheral surface of each type ring 8, and character selection teeth 11 as many as the types 10 and one reset tooth 12 are arranged in a ring on one side face of the type ring 8. The reset tooth 12 is longer than each selection tooth 11.

Figure 3:
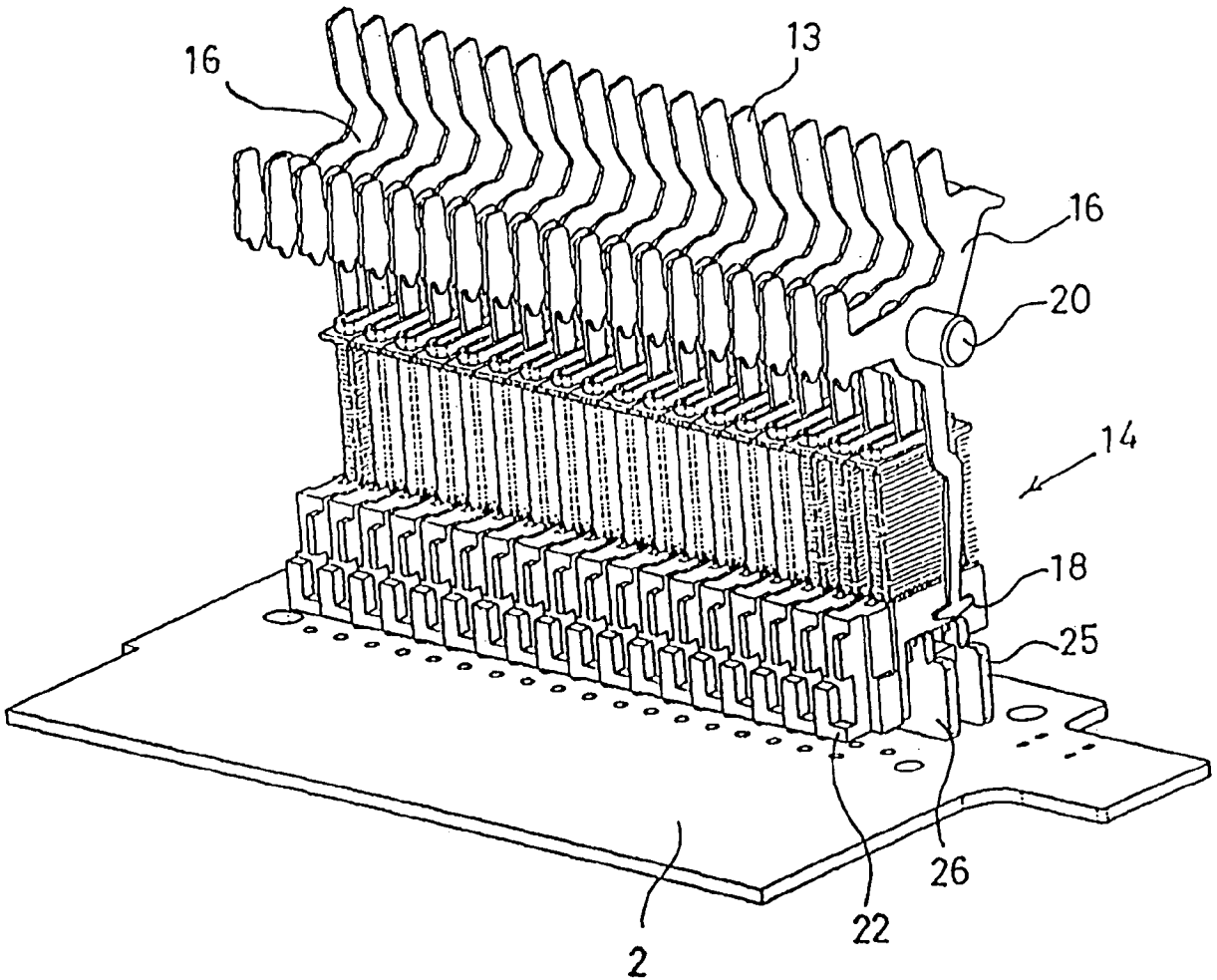
FIG. 3 is a perspective view of a type selection mechanism used in the type-printer of the first embodiment.

The type selection mechanisms 4 are arranged in association with the respective type rings 8 that constitute the ring train 3. Each selection mechanism 4 is composed of a select lever 13, electromagnetic means 14, and a cam 15. In this embodiment, as shown in FIG. 3, two dummy select levers 16 are arranged individually on the opposite sides of an array of 18 select levers 13. The dummy levers 16 are formed of the same material and have quite the same shape as the levers 13.

The 18 select levers 13 and the two dummy select levers 16 are formed by punching out the same shape from a magnetic steel plate. As shown in FIG. 2, each select lever has a hooked engaging portion 17 on its upper part. Wings protrude from the lower end of the lever in the direction across N and S poles of a permanent magnet 24, and form an opposite portion 18 that faces the permanent magnet. A projection 19 protrudes from the central part of the opposite portion 18 toward the permanent magnet 24.

As shown in FIG. 3, the 18 select levers 13 and the two dummy select levers 16 are rockably supported on a shaft 20, which extends parallel to the operating shaft 9 of the ring train 3, and are arranged at equal spaces in the axial direction of the shaft. Each of the levers 13 and 16 is supported on the shaft 20 substantially in its center of gravity.

As shown in FIG. 2, the electromagnetic means 14 is composed of magnetization coils 21 and a permanent magnet 24. The electromagnetic means 14 is arranged in association with each select lever 13. No electromagnetic means 14 is provided for the dummy select levers 16.

The magnetization coil 21 is arranged so as to surround the lower part of its corresponding select lever 13 within a range in which the lower part of the lever 13 rocks. The coil 21 is fixed to a circuit board 23 by means of a resin holder member (bobbin 22). It imparts N and S polarities to the opposite portion 18 that is formed on the lower end of the select lever 13. The bobbin 22 serves also to protect the opposite portion 18 of the lever 13.

Figure 4:
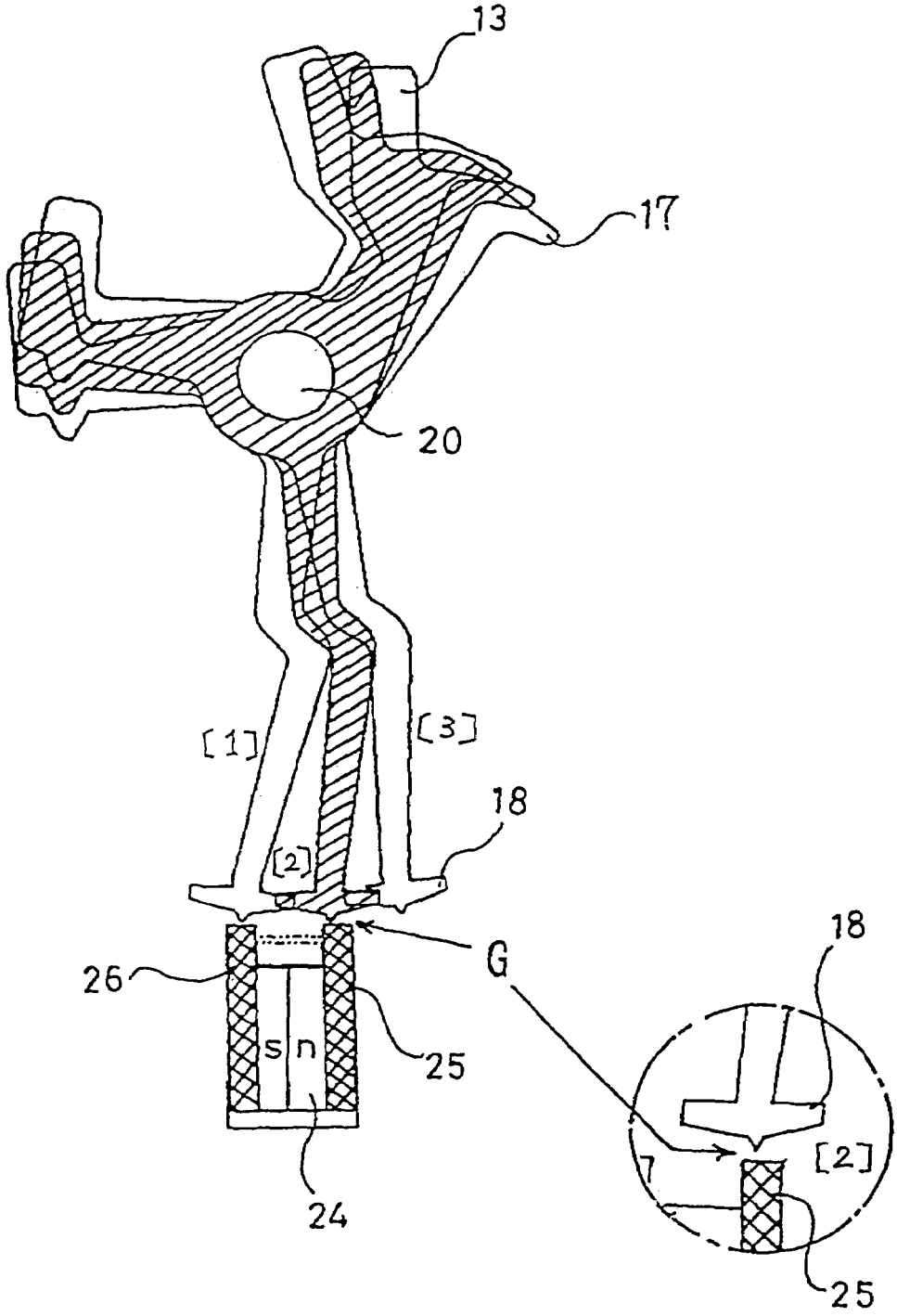
FIG. 4 is a side view showing the relation between the select lever and a permanent magnet shown in FIG. 2.

Yokes 25 and 26 are provided in association with the N and S poles, respectively, of the permanent magnet 24. As shown in FIG. 4, the opposite portion 18 of the select lever 13 is located close to and opposite the respective upper end faces of the yokes 25 and 26 with a gap G left between the projection 19 on the opposite portion and the yokes. The yokes 25 and 26 of the permanent magnet 24 extend long under the 18 aligned select levers 13 in the direction along the shaft 20. As shown in FIG. 3, the opposite end parts of the yokes are located right under their corresponding dummy select levers 16. In consequence, the lower ends of the select levers 13 are concealed by the magnetization coils 21 and the bobbins 22, and cannot be seen from the outside. Therefore, the positional relations between the lower ends of the select levers 13 and the yokes 25 and 26 are not apparent. However, they can be conjectured by externally observing those between the lower ends of the dummy select levers 16 and the yokes 25 and 26.

The cam 15 that overlies the aligned select levers 13 and the dummy select levers 16 can engage these levers 13 and 16 and bring all of them at a stroke to a position (reset tooth clear position) indicated by [3] in FIG. 2. Thus, all the select levers 13 in a character select position [1] or a character selection standby position [2] can be ranged in the reset tooth clear position [3] while the cam 15 moves from the front position [1] to the rear position [3] via the standby position [2].

The printing mechanism 5 and the ribbon feed mechanism 6 are not particularly different from conventional ones in structure.

Type selection is based on a three-position system such that, while the operating shaft 9 rotates in one direction, the select levers 13 successively take the character select position [1], standby position [2], and reset tooth clear position [3]. According to this three-position system, the operating shaft 9 is rotated only in one direction for the character selection, and unlike the case with a two-position system, need not be alternatingly rotated to complete one cycle of character selection. Thus, the three-position system entails no complicated structure.

If a type command is given, the operating shaft 9 is rotated counterclockwise, as indicated by the arrow in FIG. 2. The cam 15 is in the standby position [2] indicated by hatching in FIG. 2, while the engaging portion 17 of each select lever 13 is in a position such that it is in engagement with the reset tooth 12 and not with any of the character selection teeth 11.

In this state, the lower end of the select lever 13 is located on the side of the N-side yoke 25, as indicated by hatching in FIG. 4. If the operating shaft 9 makes a turn, therefore, all the type rings 8 that constitute the ring train 3 have their respective reset teeth 12 run against the engaging portions 17 of the select levers 13, so that the ring train 3 is set in its initial state or in the standby position [2].

In the initial stage of a second turn of the operating shaft 9, the cam 15 moves to the reset tooth clear position [3], thereby causing all the select levers 13 to rock rearward. In consequence, the respective engaging portions 17 of the select levers 13 are situated above the reset teeth 12. If the rotation of the operating shaft 9 causes the reset teeth 12 to rock, therefore, the engaging portions 17 pass by the teeth 12 without engaging them.

Since the cam 15 then immediately moves to the character select position [1], the select levers 13 are located in the standby position [2] where the opposite portions 18 on their lower ends await to be attracted to the permanent magnet 24 in response to a character select command. Although the opposite portions 18 in the standby position [2] are not in contact with the yokes 25 and 26 of the permanent magnet 24, they are kept in a stable position by attractive or repulsive force between the magnet and them, and cannot unduly move from the standby position [2].

Then, the magnetization coil 21 is energized in the necessary character select position [1] for each column in response to a print command for the column before the second turn of the operating shaft 9 is finished. The opposite portion 18 at the lower end of the energized select lever 13 moves toward the S-side yoke 26 opposite the N-side yoke 25 that has been overlain by the opposite portion 18 in the standby position [2]. In consequence, the engaging portion 17 of the select lever 13 engages one of the character selection teeth 11. Thus, one of the types is selected, and the type ring 8 that carries the selected type ceases to rotate in the then position, whereupon it slips on the operating shaft 9. The opposite portion 18 at the lower end of the lever 13 is untouched by anything when it moves toward the S-side yoke 26. It is also untouched when it is held in the position corresponding to the S-side yoke 26 by attractive force from the permanent magnet 24 after having reached the position. In consequence, the operation of the select lever 13 is stabilized, so that the engaging portion 17 of the lever 13 cannot be unexpectedly disengaged from the character selection tooth 11.

Character selection for all the columns is completed by the time when the second turn of the operating shaft 9 is finished.

The printing mechanism 5 is actuated, and the printing paper, along with the ink ribbon, is pressed against the ring train 3, whereupon printing is started.

When the printing is finished, the cam 15 moves from the character select position [1] to the standby position [2], thereby raising the engaging portions 17 of the select levers 13. Thereupon, the engaging portions 17 are disengaged from the character selection teeth 11, while they engage the reset teeth 12. Thus, all the type rings 8 on which types are selected in separate positions (and which are stopped by the engagement) are brought to their initial state as their reset teeth 12 are caused individually to engage the engaging portions 17 of the select levers 13 while the operating shaft 9 makes the first turn.

As this is done, the select levers 13 are rocked around the shaft 20. Since the center of rocking motion of each select lever 13 is coincident with the center of gravity of the lever itself, the levers 13 can rock smoothly and evenly. If the position of the center of gravity of each select lever 13 is deviated from the shaft 20, the lever 13 sometimes may be unexpectedly rocked by a moment between itself and the center of gravity, depending on the direction of external shock or vibration. In this first embodiment, however, this rocking motion can be prevented, so that there is no possibility of wrong character selection that is attributable to the movement of the select lever 13. Thus, the accuracy of character selection is improved.

In the operation described above, the magnetic attractive or repulsive force between the permanent magnet 24 and the magnetized opposite portion 18 at the lower end part of each select lever 13 is utilized to locate the lever 13 in the character select position [1] and the standby position [2] without any contact. Thus, positioning the select levers 13 involves no collision or friction. Therefore, the select levers 13 suffer no abrasion and enjoy high durability. Since the gap is formed between the permanent magnet 24 and the lower end part of each select lever 13, moreover, foreign matter cannot be trapped easily. Although the printing paper never fails to produce paper dust, in particular, the influence of the paper dust can be eliminated. Since the select levers 13 can be thus positioned without contact, moreover, the magnetic positioning cannot be influenced much by the surface finish of the lower end faces of the levers 13.

The select levers 13 are moved to the reset tooth clear position [3] by the operation of the cam 15. Like the center of rocking motion of each select lever 13 that moves to the character select position [1] or the standby position [2], the center of rocking motion of the cam 15 lies in the shaft 20. Unlike in the conventional case, no complicated structure is needed to lift up all the select levers 13 and the shaft 20 or to rock the entire assembly around a separate rocking shaft. Since the whole unit including the shaft 20 is not rocked, moreover, moving or stopping the elements produces only low inertia, and the shock that is generated when the whole unit is moved can be prevented. Thus, the positional relations between the permanent magnet 24 and the lower ends of the select levers 13 cannot be disturbed.

In the first embodiment, the wings protrude from the lower end of each select lever 13 in the direction across the N and S poles of the permanent magnet 24, and form the opposite portion 18 that faces the permanent magnet. Thus, the combination of the opposite portion 18 and the lower part of the select lever 13 is substantially in the shape of an inverted T. If the opposite portion 18 is located on one pole side (e.g., S-pole side) of the permanent magnet 24, with this shape of the opposite portion 18, one of the wings that constitute the opposite portion 18 is situated close to the other pole side (N-pole side) of the magnet 24. Thus, the select lever 13 can smoothly move between the character select position [1] and the standby position [2]. If the projection 19 is formed protruding from the central part of the opposite portion 18 toward the magnet 24, moreover, magnetic flux is concentrated on the projection 19, so that the select lever 13 can be positioned with higher stability.

Since the combination of the opposite portion 18 and the lower part of the select lever 13 is substantially in the shape of an inverted T, as mentioned before, the one wing that forms the opposite portion 18 is situated close to the permanent magnet 24 even when the lever 13 returns from the reset tooth clear position [3] to the standby position [2]. If the restriction by the cam 15 is removed, therefore, the one wing is attracted to the permanent magnet 24 whereupon the select lever 13 smoothly reaches the standby position [2]. This movement of the select lever 13 requires no use of any special return spring.

In the first embodiment, as shown in FIG. 3, the dummy select levers 16, which are formed of the same material and have quite the same shape as the select levers 13, are arranged individually on the opposite sides of the 18 aligned select levers 13 on the shaft 20 under the same setting conditions. Therefore, any of the aligned select levers 13 is sandwiched between two other select levers 13 or between one select lever 13 and one of the dummy select levers 16 of the same material having the same shape. Thus, all the select levers 13 share the same magnetic environment. In consequence, all the select levers 13 can enjoy even, stable character selection.

Further, each dummy select lever 16 is not provided with the magnetization coil 21, and can be located so that the positional relation between its lower end and the permanent magnet 24 can be visually observed from the outside. Therefore, the positional relation between the lower end of each select lever 13, which is concealed under the bobbin 22 and the like, and the magnet 24 can be learned by externally observing the relation between the lower end of the dummy select lever 16 and the magnet 24.

Figure 5:
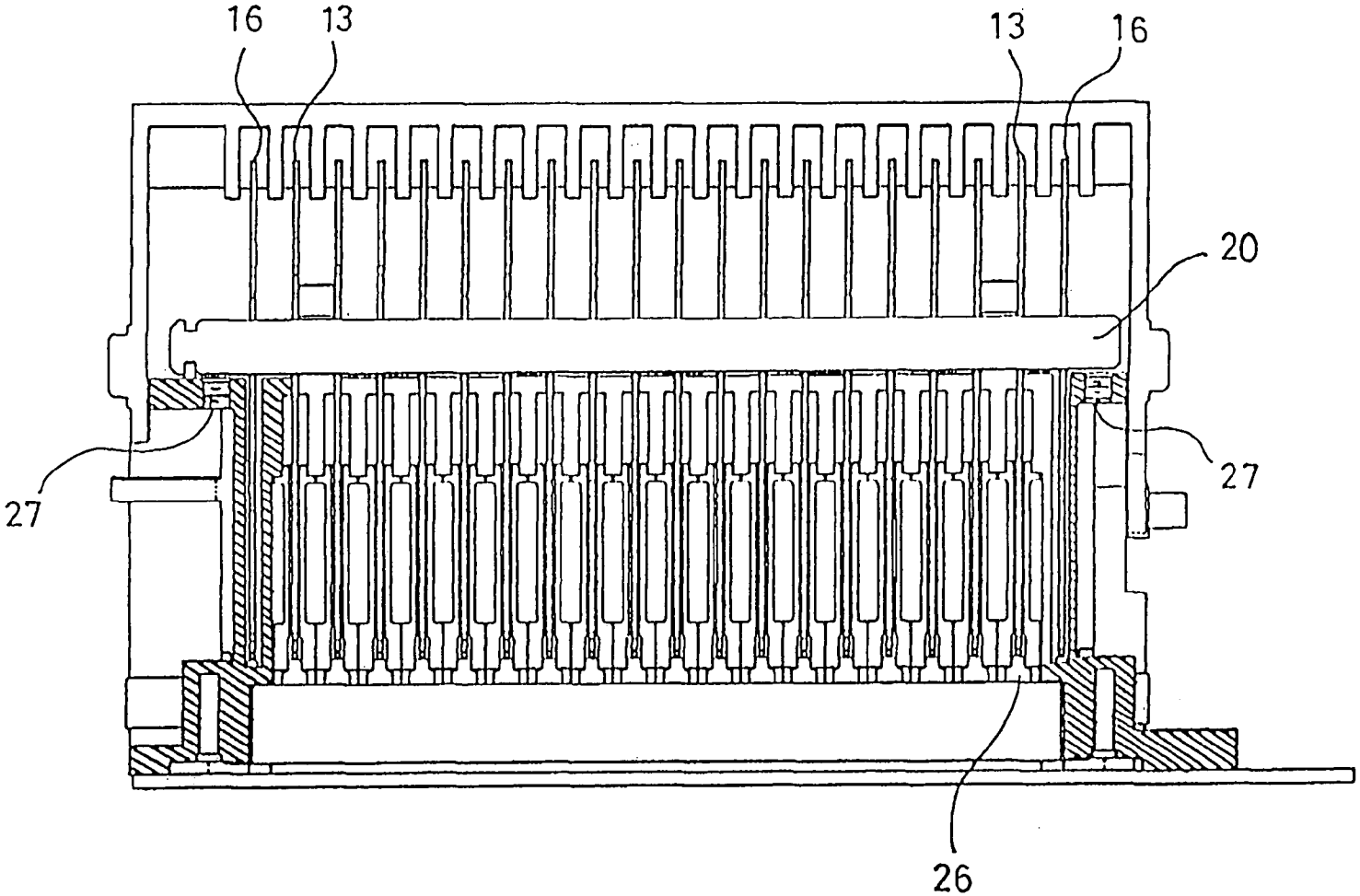
FIG. 5 is a front view showing an example (modification of the first embodiment) in which a shaft supporting a plurality of select levers are supported by means of adjusting screws.

As shown in FIG. 5, the opposite ends of the shaft 20 may be supported individually by means of adjusting screws 27 that are attached to the bobbins 22 so that gaps between the permanent magnet 24 and the respective lower ends of the select levers 13 and the dummy select levers 16 can be adjusted. Even if the gap G (see FIG. 4) between each select lever 13 and the permanent magnet 24 is unseen after they are assembled together, it can be properly adjusted while the gap G between each dummy select lever 16 and the magnet 24 is observed. Thus, the spaces between the permanent magnet and the select levers 13 can be easily adjusted by utilizing the dummy select levers 16.

A type-printer according to a second embodiment of the invention will now be described with reference to FIG. 6.

Figure 6:
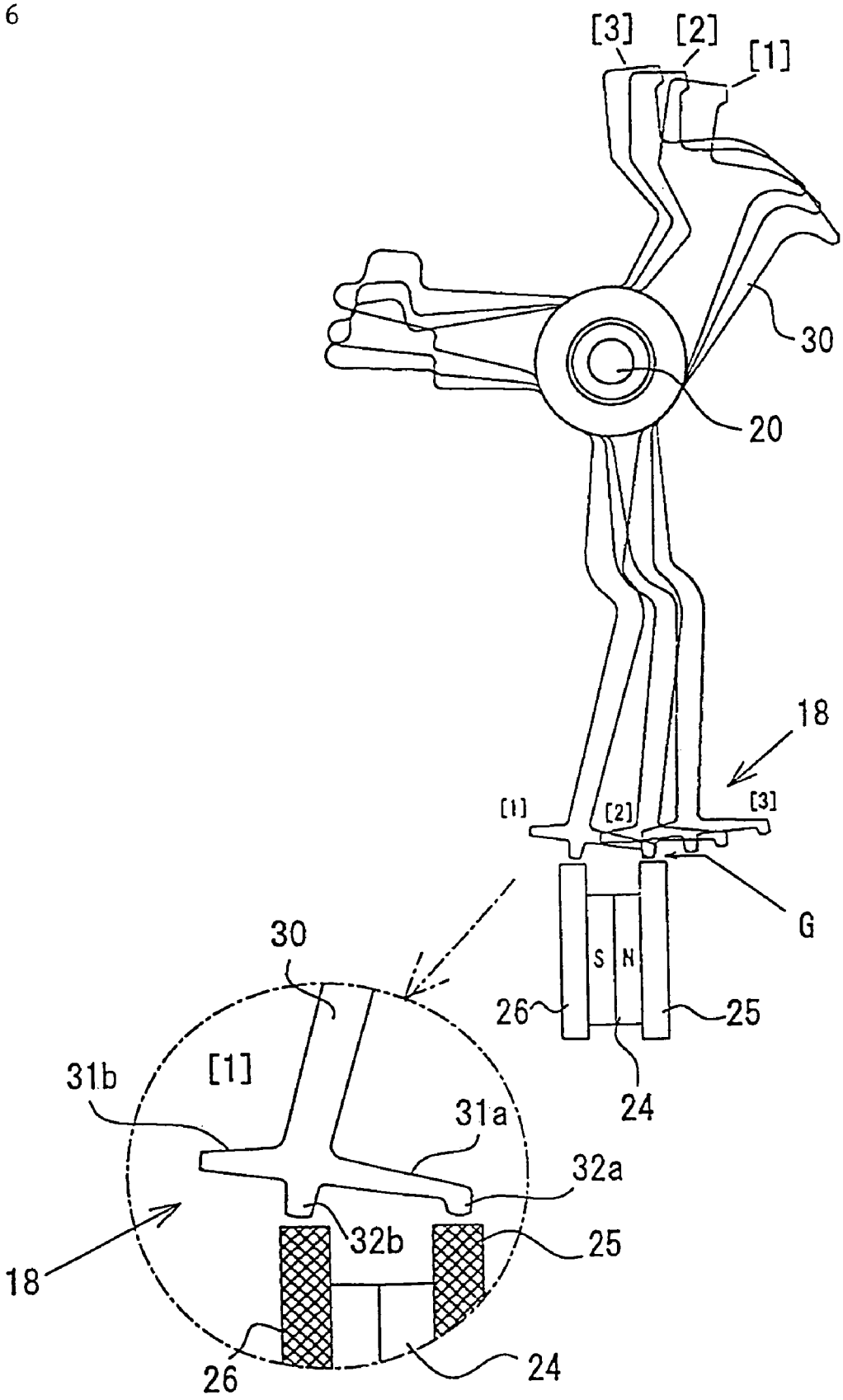
FIG. 6 is a side view showing outlines of a select lever and a permanent magnet used in a type-printer of a second embodiment of the invention.

FIG. 6 shows a select lever 30 used in the type-printer of the second embodiment. This embodiment is arranged in the same manner as the first embodiment except for the configuration of select levers. The same reference numerals are used for component parts identical with those in the first embodiment.

The select lever 30 of this embodiment is a modification of the select lever 13 shown in FIG. 4 (first embodiment), and has an opposite portion 18 that is constructed differently from the opposite portion 18 of the select lever 13 shown in FIG. 4.

First and second wings 31*a* and 31*b* are formed protruding from the lower end of the select lever 30 in the direction across N and S poles of a permanent magnet 24, and form the opposite portion 18 that faces the permanent magnet. Thus, the combination of the opposite portion 18 (wings 31*a* and 31*b*) and the lower part of the select lever 30 is substantially in the shape of an inverted T. The width of the opposite portion 18 (or its dimension in the rocking direction of the select lever 30) is equal to or greater than the width of the permanent magnet 24. The first wing 31*a* that forms the opposite portion 18 has a length that covers N- and S-side yokes 25 and 26 when the select lever 30 is in the character select position [1]. The first wing 31*a* is formed having first and second projections 32*a* and 32*b*, which extend downward (or toward the magnet 24) from its distal end part and basal part, respectively. The first and second projections 32*a* and 32*b* are opposed to the N- and S-side yokes 25 and 26, respectively.

The second wing 31*b* that forms the opposite portion 18 is shorter than the distance between the N- and S-side yokes 25 and 26. It is formed so as to project toward the S-side yoke 26 when the select lever 30 and the second projection 32*b* of the first wing 31*a* are in the standby position [2] and right over the N-side yoke 25, respectively.

When the select lever 30 is in the standby position [2], the second wing 31*b* that constitutes the opposite portion 18 projects toward the S-side yoke 26. Accordingly, the magnetic polarity of the lever 30 is changed, and the lever 30 smoothly starts to move from the standby position [2] to the character select position [1]. When the select lever 30 reaches the character select position [1], the first and second projections 32*a* and 32*b* of the first wing 31*a* are situated right over the N- and S-side yokes 25 and 26, respectively. Since the two projections 32*a* and 32*b* are opposed to the yokes 25 and 26, respectively, restriction by magnetic force is so strong that the select lever 30 in the character select position [1] never moves unexpectedly. When the lever 30 returns from the reset tooth clear position [3] to the standby position [2], moreover, the second wing 31*b* that constitutes the opposite portion 18 comes close to the permanent magnet 24. When the restriction by the cam 15 is removed, therefore, the movement to the standby position [2] is started smoothly.

Thus, according to the configuration of the second embodiment, the select lever 30 can be positioned more stably, and the movement can be started more smoothly.

A type-printer according to a third embodiment of the invention will now be described with reference to FIGS. 7 and 8.

Figure 7:
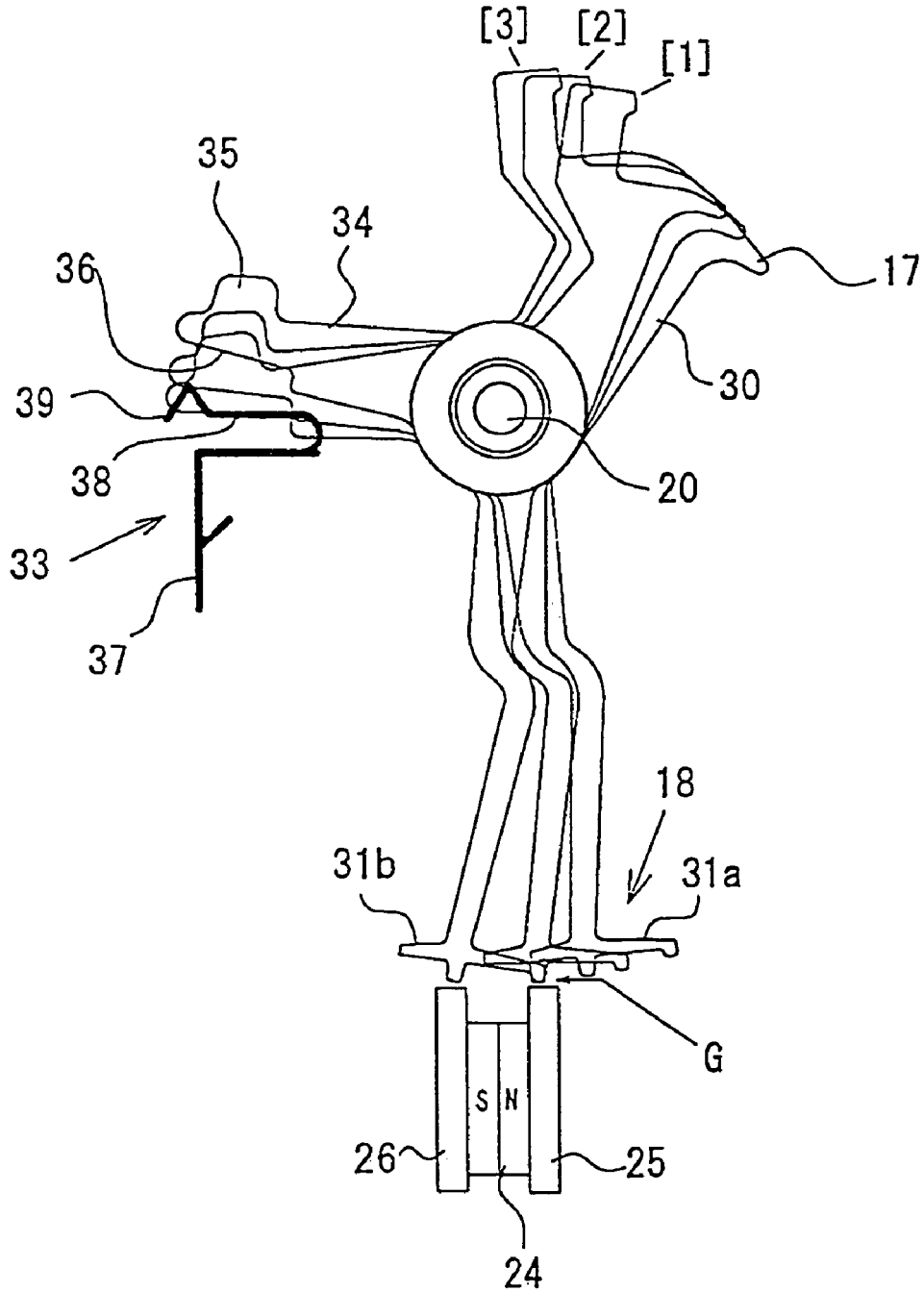
FIG. 7 is a side view showing outlines of a select lever and a spring body used in a type-printer of a third embodiment of the invention.
Figure 8:
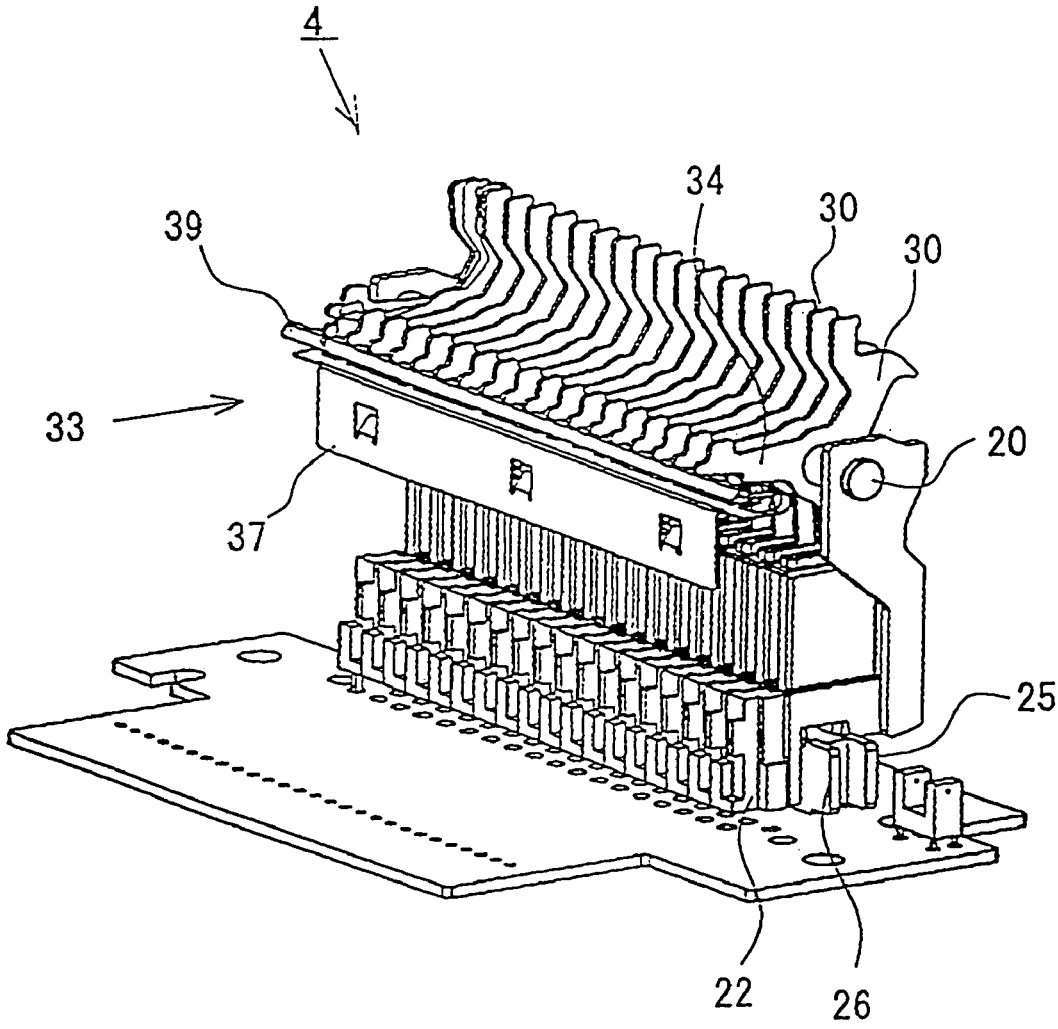
FIG. 8 is a perspective view showing a type selection mechanism used in the type-printer of the third embodiment.

FIGS. 7 and 8 show a type selection mechanism 4 used in the type-printer of the third embodiment. This embodiment differs from the second embodiment in that a spring body 33 is attached to the rear part (or the part on a side opposite a ring train 3) of a select lever 30. The third embodiment shares other configurations with the second embodiment, and the same reference numerals are used for component parts identical with those in the second embodiment.

An engaging portion 17 is formed on the upper front part of the select lever 30, while an arm 34 extends rearward from the rear part of the lever 30. A balancing projection 35 and a spring bearing surface 36 are formed on the upper and lower parts, respectively, of the arm 34, on its rear end side. The spring body 33 is an integral component that is formed of a tabular fixing portion 37, a leaf portion 38, and an abutting portion 39. The leaf portion 38 is formed by stamping a tabular portion. The abutting portion 39 extends rearward from one end of the leaf portion 38. The leaf portion 38 applies repulsive force to the abutting portion 39 when bending in the shape of a U. The fixing portion 37 is attached to a fixing portion of the machine frame 2 of the character printer 1, and the abutting portion 39 is arranged under the arm 34 of each of select levers 30 that are aligned on a shaft 20.

When the cam 15 sets the select lever 30 in the reset tooth clear position [3], the leaf portion 38 of the spring body 33 is collapsed by the arm 34 from above. If the cam 15 then moves to the standby position [2], the leaf portion 38 is restored, and the abutting portion 39 pushes up the arm 34. Thereupon, the aligned select levers 30 are returned at a stroke to the standby position.

Thus, all the select levers 30 can be quickly moved at a stroke to the standby position, so that the character selection is accurate and secure.

A type-printer according to a fourth embodiment of the invention will now be described with reference to FIG. 9.

Figure 9:
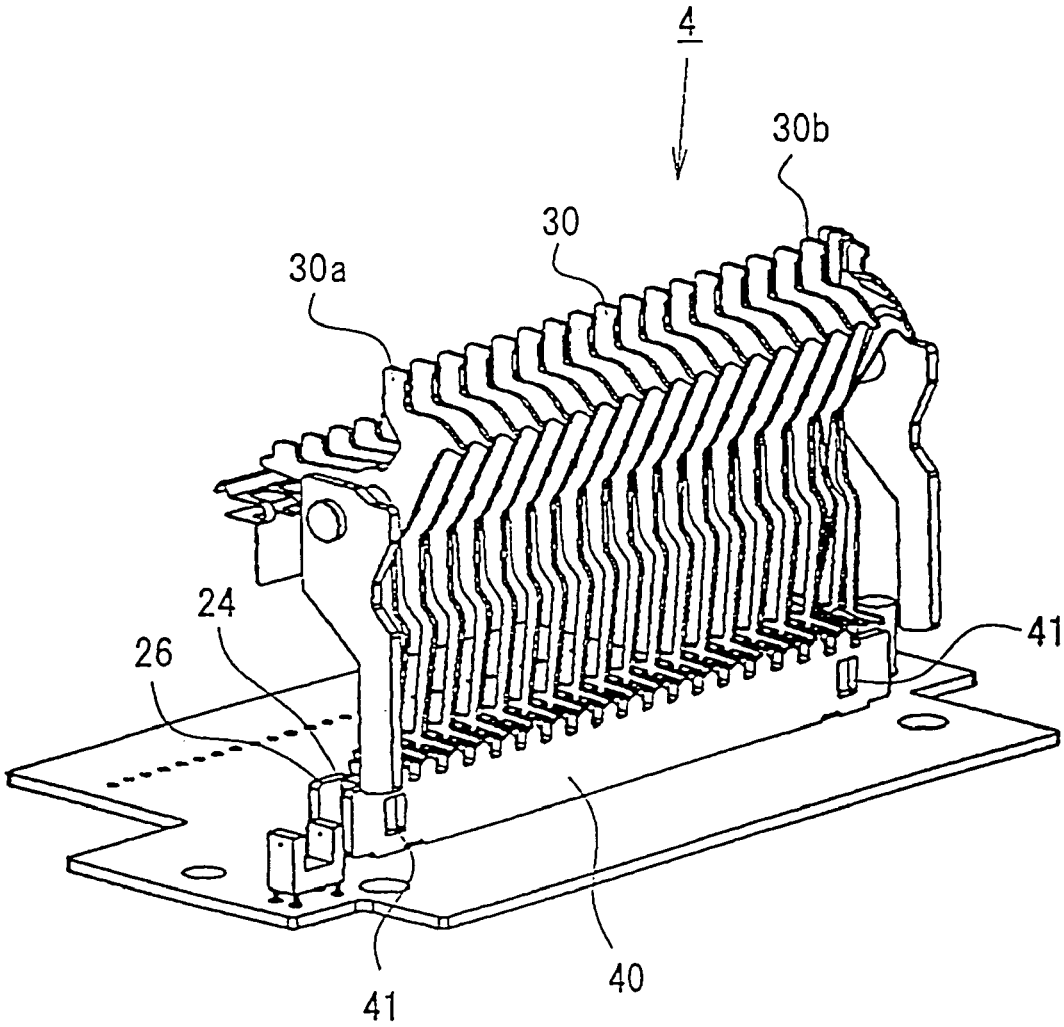
FIG. 9 is a perspective view showing a type selection mechanism used in a type-printer according to a fourth embodiment of the invention.

FIG. 9 shows a type selection mechanism 4 used in the type-printer of the fourth embodiment. This embodiment differs from the second embodiment only in the construction of yokes. The same reference numerals are used for component parts identical with those in the second embodiment. In the state shown in FIG. 9, the type selection mechanism is cleared of a resin holder (mentioned later).

A yoke 40 shown in FIG. 9 is a modification of the N-side yoke 25 (on the side of the standby position [2]) of FIG. 6 (second embodiment). The yoke 40 is formed with adjusting holes 41, which are located individually right under end select levers 30*a* and 30*b*, out of a plurality of select levers 30 that are arranged along a shaft 20. The adjusting holes 41 are formed in order to reduce the mass of the corresponding parts of the yoke 40. Thus, the holes 41 may be bottomed recesses or notches, as well as through holes, with which the mass of the corresponding parts can be reduced.

In the type selection mechanism 4, each of the select levers 30 is influenced by the magnetic force of the select levers 30 that are located on either side of it as the levers rock. Since the select levers 30*a* and 30*b*, located on the left end side and right end side respectively, do not adjoin another select lever on the left or right side, however, these select lever 30*a* and 30*b* are influence by the right- or left-hand select lever only. Thus, the select levers 30*a* and 30*b* on the left and right end sides act differently from the remaining (central) select levers 30, so that character selection timing may shift in some cases.

However, the adjusting holes 41 are formed in the yoke 40 at areas right under the select levers 30*a* and 30*b* located on the left and right end sides, individually, so that magnetic flux in these areas is reduced. Thus, the magnetic attractive or repulsive force of the select lever 30*a* and 30*b* on the left and right end sides with respect to the opposite portion 18 can be made substantially equal to that of the remaining (central) select lever 30 with respect to the opposite portion 18. In consequence, all the select levers 30 can enjoy accurate character selection without timing shift.

A type-printer according to a fifth embodiment of the invention will now be described with reference to FIGS. 10 and 11.

Figure 10:
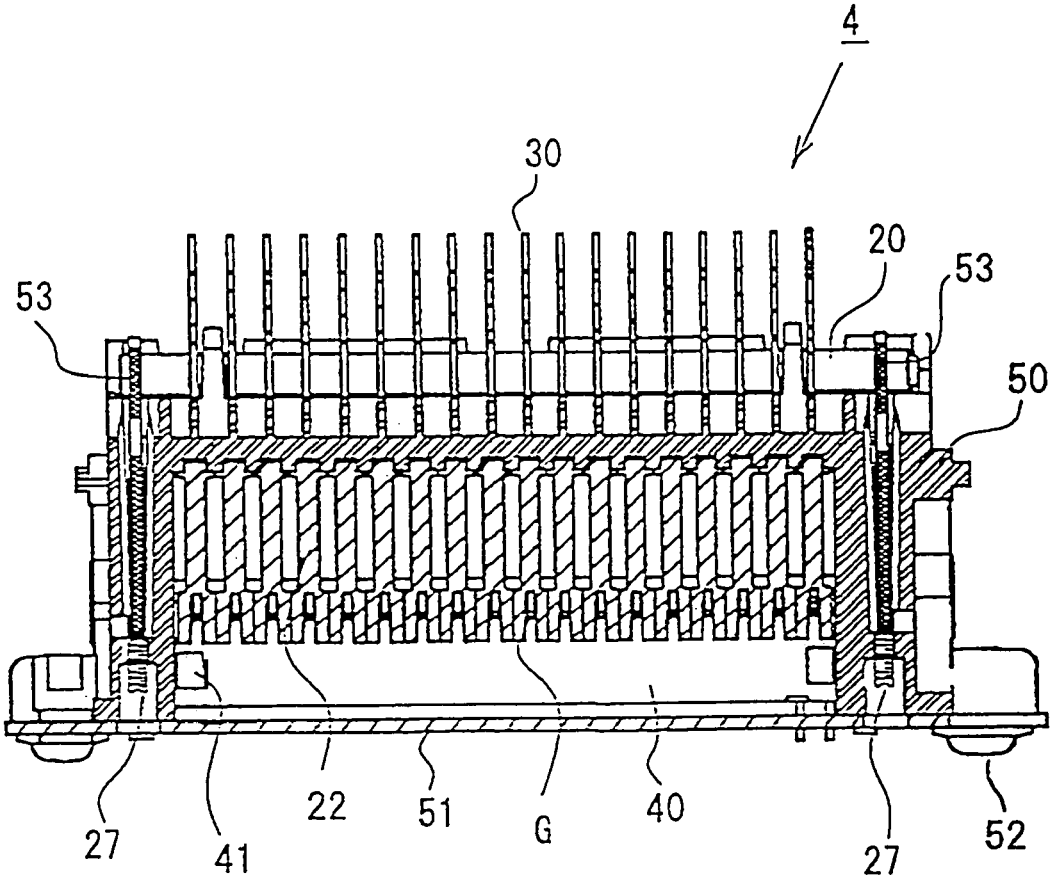
FIG. 10 is a sectional view showing a type selection mechanism used in a type-printer according to a fifth embodiment of the invention.
Figure 11:
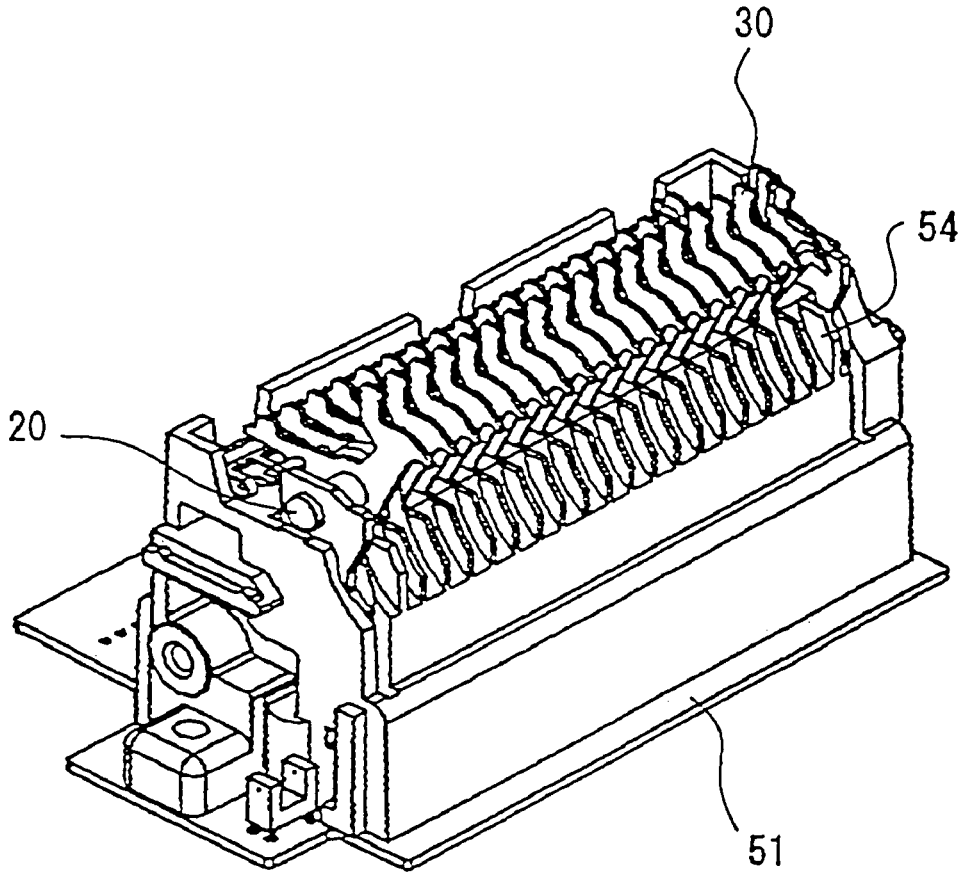
FIG. 11 is a perspective view of the type selection mechanism shown in FIG. 10.
Figure 12:
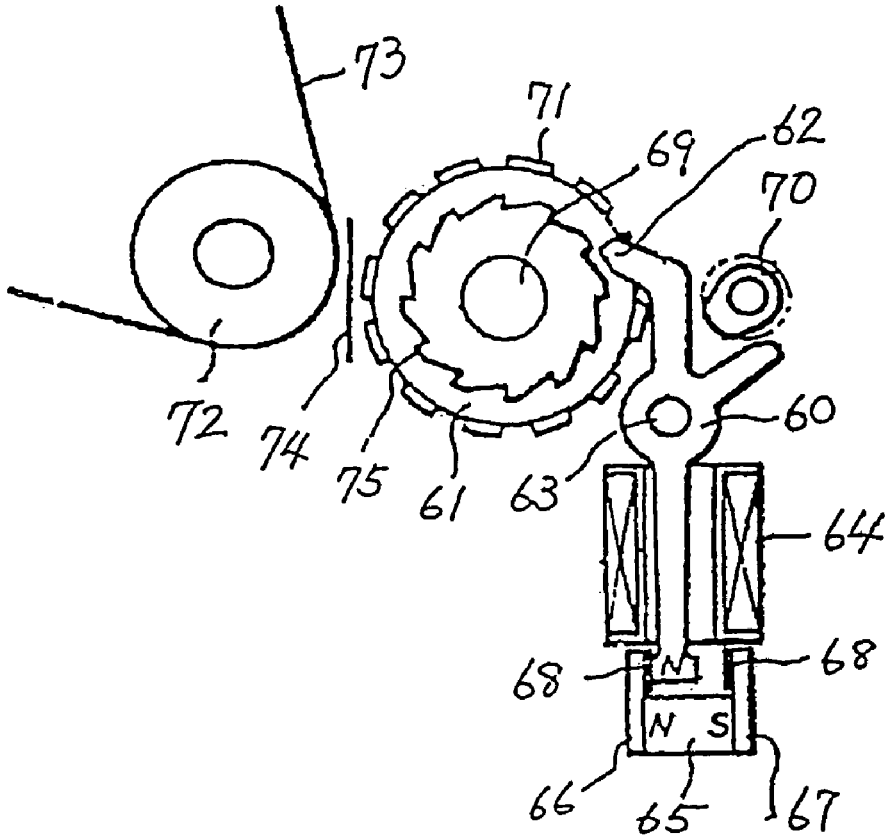
FIG. 12 is a side view showing outlines of a type ring, select lever, and electromagnetic means used in a prior art type-printer.

FIGS. 10 and 11 show a type selection mechanism 4 used in the type-printer of the fifth embodiment. This embodiment is characterized by a position adjustment mechanism for a shaft 20 on which select levers 30 are mounted, and shares other configurations with the second embodiment. The same reference numerals are used for component parts identical with those in the second embodiment.

Numeral 50 denotes a resin holder, which is fixed to a circuit board 51 by means of screws 52. The respective lower parts of metallic support members 53 are located individually on the opposite sides of the holder 50. The respective lower ends of the support members 53 abut individually against adjusting screws 27 that are attached to the base portion of the holder 50. The respective upper parts of the support members 53 individually support the opposite ends of the shaft 20 on which the select levers 30 are mounted. The position where the lower part of each support member 53 abuts against its corresponding adjusting screw 27 corresponds to a gap G across which an opposite portion 18 of each select lever 30 faces yokes 26 and 40.

The gap G between the opposite portion 18 at the lower end of each select lever 30 and the yokes 26 and 40 of a permanent magnet 24 is adjusted properly. According to this arrangement, the shaft 20 is supported by the metallic support members 53 that are subject to little thermal deformation. Even if its temperature is increased, therefore, the shaft 20 suffers little vertical motion, so that the gap G can be kept substantially fixed. Since each support member 53 is substantially as long as each select lever 30, moreover, they can be extended or contracted to the same degree by temperature change. If the select lever 30 is extended downward by a temperature rise, for example, the support member 53 extends upward from the corresponding adjusting screw 27, thereby canceling the downward elongation of the lever 30. This also enhances the function to keep the gap G substantially fixed.

The permanent magnet 24 and its yokes 26 and 40 are arranged in the bottom of the resin holder 50, and bobbins 22 of magnetization coils 21 are located on the top of the holder. The bobbins 22 are molded integrally with the holder 50 and arranged in association with the select levers 30, individually. Further, the top surface of the holder 50 is formed with holes that are penetrated by the respective lower parts of the select levers 30, and separators 54 are formed at equal spaces and longitudinally aligned with their corresponding holes. A type ring 8 is situated between each two adjacent separators 54.

Since the separators 54 are molded integrally with the resin holder 50 in this manner, the positional relations between the separators 54 and the holes that are penetrated by the lower parts of the select levers 30 can be univocally determined with ease. Thus, the type rings and the select levers 30 for selecting types thereon can be positioned with high accuracy.

What is claimed is:

1. A type-printer comprising:

a type ring having types on the peripheral surface thereof;

a permanent magnet or a permanent magnet to which a yoke is integrally attached;

a select lever formed of a magnetic material, supported for rocking motion around a shaft, and having an engaging portion on one end thereof to engage the type ring and an opposite portion on the other end to face the permanent magnet across a gap; and a coil for imparting magnetic polarity to the select lever, wherein the select lever is rocked by means of attractive or repulsive force produced between the magnetic polarity of the select lever imparted by the coil and the magnetic polarity of the permanent magnet or the yoke, whereby the engaging portion of the select lever is anchored to or disengaged from the type ring to select the types, and the select lever is located in a stable position settled by the respective magnetic polarities of the select lever and the permanent magnet or the yoke, and a) where a yoke is not present, a gap exists between the opposite portion and the permanent magnet, and b) where at least one yoke is present, a gap exists between the opposite portion and the permanent magnet and further a gap exists between the opposite portion and an adjacent-most yoke.

2. The type-printer according to claim 1, wherein the opposite portion extends long from the other end of the select lever in the direction across N and S poles of the opposite permanent magnet.

3. The type-printer according to claim 1, wherein the central part of the opposite portion is formed with a projection projecting toward the permanent magnet.

4. The type-printer according to claim 3, further comprising a pair of yokes wherein the permanent magnet is arranged so that the direction across the N and S poles is coincident with the direction in which the opposite portion moves as the select lever rotates and is provided with the yokes on the opposite pole sides, individually, and the projection of the opposite portion is located close to the upper end part of one of the yokes, depending on the magnetic polarity imparted from the coil to the select lever.

5. The type-printer according to claim 1, wherein the select lever is supported on the shaft substantially in the center of gravity thereof.

6. The type-printer according to claim 1, wherein the type ring is in engagement with an operating shaft rotatable in one direction only and has a reset tooth for resetting each type, and the select lever can take a reset tooth clear position in which the engaging portion to engage the type ring is caused to clear the reset tooth by cam means.

7. The type-printer according to claim 6, which further comprises a spring member which urges the select lever toward the stable position when the select lever is in the reset tooth clear position.

8. The type-printer according to claim 1, comprising a plurality of select levers and a plurality of type rings, and wherein the select levers are aligned substantially at equal spaces in the axial direction of a train of the type rings in layers, and a dummy select lever having substantially the same shape as the select levers is aligned together with the select levers on at least one of the opposite sides of the aligned select levers without engaging the type rings.

9. The type-printer according to claim 8, wherein an end part of the dummy select lever opposite the permanent magnet is exposed so that a gap between the end part of the dummy select lever and the permanent magnet can be visually observed.

10. The type-printer according to claim 1, wherein the opposite portion of the select lever has a width equal to or greater than that of the permanent magnet in the rocking direction of the select lever.

11. The type-printer according to claim 10, wherein the permanent magnet has two yokes formed with magnetic poles in the direction of the width, and those parts of the opposite portion of the select lever which face the two yokes are each formed with a projection projecting toward the corresponding yoke.

12. The type-printer according to claim 11, wherein the select lever is rockable between a character select position in which the two projections of the opposite portion face the yokes, individually, and a standby position in which only one of the projections faces one of the yokes, and the opposite portion has an extended part extending toward the character select position from that one of the two yokes which is situated on the character select position side.

13. The type-printer according to claim 12, comprising a plurality of select levers and a plurality of type rings, and wherein the select levers are aligned in the axial direction of a train of the type rings in layers, and that one of the two yokes which is situated on the standby position side has portions with mass removed corresponding in position to those ones of the select levers which are situated at the opposite ends.

14. The type-printer according to claim 1, wherein the select lever is supported on an operating shaft, and which further comprises an adjusting screw capable of regulating the operating shaft for movement to adjust the distance of the select lever from the permanent magnet.

15. The type-printer according to claim 14, wherein the operating shaft of the select lever is supported on a metallic support member mounted on a resin holder member, and the adjusting screw is attached to the holder member and adjusts the position of the operating shaft with the aid of the metallic support member.

16. A type-printer comprising:

a type ring having types on the peripheral surface thereof;

a permanent magnet;

a select lever formed of a magnetic material, supported for rocking motion around a shaft, and having an engaging portion on one end thereof to engage the type ring and an opposite portion on the other end to face the permanent magnet across a gap; and a coil for imparting magnetic polarity to the select lever, wherein the select lever is rocked by means of attractive or repulsive force produced between the magnetic polarity of the select lever imparted by the coil and the magnetic polarity of the permanent magnet, whereby the engaging portion of the select lever is anchored to or disengaged from the type ring to select the types, the select lever is located in a stable position settled by the respective magnetic polarities of the select lever and the permanent magnet with a gap left between the opposite portion and the permanent magnet the opposite portion of the select lever has a width equal to or greater than that of the permanent magnet in the rocking direction of the select lever, the permanent magnet has two yokes formed with magnetic poles in the direction of the width, and those parts of the opposite portion of the select lever which face the two yokes are each formed with a projection projecting toward the corresponding yoke, the select lever is rockable between a character select position in which the two projections of the opposite portion face the yokes, individually, and a standby position in which only one of the projections faces one of the yokes, and the opposite portion has an extended part extending toward the character select position from that one of the two yokes which is situated on the character select position side.

17. A type-printer comprising:

a type ring having types on the peripheral surface thereof;

a permanent magnet or a yoke and permanent magnet combination;

a select lever formed of a magnetic material, supported for rocking motion around a shaft, and having an engaging portion on one end thereof to engage the type ring and an opposite portion on the other end to face the permanent magnet across a gap; and a coil for imparting magnetic polarity to the select lever, wherein the select lever is rocked by means of attractive or repulsive force produced between the magnetic polarity of the select lever imparted by the coil and the magnetic polarity of the permanent magnet, whereby the engaging portion of the select lever is anchored to or disengaged from the type ring to select the types, and the select lever is located in a stable position settled by the respective magnetic polarities of the select lever and the permanent magnet, and a) where a yoke is not present, a gap exists between the opposite portion and the permanent magnet, and b) where at least one yoke is present, a gap exists between the opposite portion and the permanent magnet and further a gap exists between the opposite portion and an adjacent-most yoke.

18. The type-printer according to claim 17, wherein the central part of the opposite portion is formed with a projection projecting toward the permanent magnet.

19. The type-printer according to claim 17, wherein the select lever is supported on the shaft substantially in the center of gravity thereof.

20. The type-printer according to claim 17, wherein there is present said yoke and permanent magnet combination, which combination comprises a pair of yokes integrally joined to opposite sides of said permanent magnet, and the opposite portion of the select lever has a width equal to or greater than that of the combination of the yokes and permanent magnet in the rocking direction of the select lever.

* * * * *